US008750768B2

(12) United States Patent
Kotani et al.

(10) Patent No.: US 8,750,768 B2
(45) Date of Patent: Jun. 10, 2014

(54) MAGNET ROLLER

(75) Inventors: Setsuo Kotani, Ageo (JP); Kiyoshi Ida, Tochigi (JP); Kazuhiko Ogino, Tokyo (JP)

(73) Assignee: P.M. Giken Inc., Saitama (JP)

( * ) Notice: Subject to any disclaimer, the term of this patent is extended or adjusted under 35 U.S.C. 154(b) by 69 days.

(21) Appl. No.: 13/640,554

(22) PCT Filed: May 12, 2011

(86) PCT No.: PCT/JP2011/060902

§ 371 (c)(1),
(2), (4) Date: Nov. 8, 2012

(87) PCT Pub. No.: WO2011/152179

PCT Pub. Date: Dec. 8, 2011

(65) Prior Publication Data

US 2013/0051865 A1 Feb. 28, 2013

(30) Foreign Application Priority Data

Jun. 2, 2010 (JP) ..... 2010-138712

(51) Int. Cl.
*G03G 15/09* (2006.01)

(52) U.S. Cl.
USPC ..... 399/277

(58) Field of Classification Search
CPC ..... G03G 15/0928; G03G 15/0921
USPC ..... 399/277
See application file for complete search history.

(56) References Cited

U.S. PATENT DOCUMENTS 6,125,255 A * 9/2000 Litman et al. ..... 399/277
6,422,984 B1 * 7/2002 Masham et al. ..... 492/8
6,762,665 B1 * 7/2004 Iwai et al. ..... 335/306

(Continued)

FOREIGN PATENT DOCUMENTS

JP 61-90212 U 6/1986
JP 7-1455 U 1/1995

(Continued)

OTHER PUBLICATIONS

International Preliminary Report on Patentability for PCT/JP2011/060902, mailed Dec. 4, 2012.

(Continued)

*Primary Examiner* — Clayton E LaBalle
*Assistant Examiner* — Leon W Rhodes, Jr.
(74) *Attorney, Agent, or Firm* — Greenblum & Bernstein, P.L.C.

(57) ABSTRACT

A magnet roller according to the present invention comprises: a single metal shaft member; and a pair of first and second semicylindrical resin magnet members each of which is shorter than the metal shaft member and has a first or second annular portion integrally provided at one end portion thereof. Each of first and second central holes is provided at the center of each of the first and second annular portions. The magnet roller according to the present invention is assembled by arranging the first annular portion and the second annular portion so as not face each other, inserting both end portions of the metal shaft member into the first and second central holes from the inner side of the first and second annular portions, and sandwiching the metal shaft member between the first and second semicylindrical resin magnet members in such a manner that both the end portions of the metal shaft member protrude to the outside of the first and second annular portions.

9 Claims, 8 Drawing Sheets

(56) References Cited

U.S. PATENT DOCUMENTS

| | | | | |
|---|---|---|---|---|
| 6,788,178 | B2 * | 9/2004 | Inase et al. | 335/306 |
| 8,035,273 | B2 * | 10/2011 | Ionel et al. | 310/261.1 |
| 8,646,595 | B2 * | 2/2014 | Miller et al. | 198/779 |
| 2008/0315716 | A1 * | 12/2008 | Itoh et al. | 310/263 |

FOREIGN PATENT DOCUMENTS

| | | |
|---|---|---|
| JP | 09-179408 | 7/1997 |
| JP | 09-211988 | 8/1997 |
| JP | 10-116714 | 5/1998 |
| JP | 2006-18189 | 1/2006 |
| JP | 2008-270286 | 11/2008 |

OTHER PUBLICATIONS

English Abstract of JP 61-090212 U, published Jun. 12, 1986.

* cited by examiner

MAGNET ROLLER

TECHNICAL FIELD

The present invention relates to a magnet roller for use in a developing device or a cleaning device in an image forming apparatus such as a printer, a copier, or a facsimile equipment that forms an image using a toner.

BACKGROUND ART

In an image forming apparatus such as a printer, a copier, or a facsimile equipment that forms an image using a toner consisting of powder, a magnet roller having a plurality of magnetic poles in a circumferential direction is used in a developing device or a cleaning device. The magnet roller used in the developing device develops an electrostatic latent image formed on a photoconductor drum surface by using a charged toner, and the magnet roller used in the cleaning device removes the charged toner remaining on the photoconductor drum surface.

In regard to the magnet roller, Patent Documents 1, 2, and 3 disclose examples of connecting two semicylindrical resin magnets and forming a cylindrical magnet roller. That is, in all of these examples, the magnet roller constituted of the two semicylindrical resin magnets is provided, and a shaft protruding from both ends is produced by utilizing end portions of the resin magnets.

Connecting the plurality of resin magnets to one independent metal shaft to manufacture the magnet roller has been well-known and, for example, Patent Document 4 discloses that five magnet pieces each having a fan-shaped cross section are attached to a metal shaft to form a magnet roller.

Pressing a metal shaft into an inner hole of a resin magnet extruded into a cylindrical shape to form a magnet roller has been also well-known and, for example, Patent Document 5 discloses that a cored bar is pressed into a cylindrical resin magnet using an elastomer resin like an EEA resin as a binder and a magnet roller is formed.

PRIOR ART DOCUMENTS

Patent Documents

Patent Document 1: Japanese Unexamined Patent Application Publication No. Hei 9-179408

Patent Document 2: Japanese Unexamined Patent Application Publication No. Hei 9-211988

Patent Document 3: Japanese Unexamined Patent Application Publication No. 2006-18189

Patent Document 4: Japanese Unexamined Patent Application Publication No. 2008-270286

Patent Document 5: Japanese Unexamined Patent Application Publication No. Hei 10-116714

DISCLOSURE OF INVENTION

Problem to be Solved by the Invention

However, since the magnet roller disclosed in each of Patent Documents 1, 2, and 3 is formed by fitting using the half-cut semicylindrical resin magnets alone, there is a problem that molding strain caused due to uneven residual stress at the time of injection molding of the resin magnet is hardly corrected and a dimension accuracy of the obtained magnet roller in a roller axis direction is not sufficient.

Further, when a shaft portion requires conductivity, there arises complexity that the shaft portion must be additionally subjected to conductivity processing.

In the magnet roller disclosed in Patent Document 4, the rod-like magnet pieces each of which has one magnetic pole and a fan-shaped cross section are attached to a metal shaft through an adhesive for the required number of magnetic poles. The adhesive often contains a solvent, mixing of the adhesive has a demerit, i.e., an increase in segregation load at the time of recycle of the magnetic roller, and hence it cannot be said heavy use of the adhesive is desirable for the environment.

Further, there is a problem that positioning with respect to a metal shaft is difficult at the time of attaching each piece and working properties or productivity in an attachment process is apt to be reduced.

In the magnet roller disclosed in Patent Document 5, a metal shaft must be able to be smoothly pressed into a cylindrical extruded rein magnet, the contact of the resin magnet and the metal must be excellent, and resistance at the time of removal must be high. Therefore, there is a problem of coping with complicated matters, e.g., performing special processing to a surface of the metal shaft, providing a preferred elastic modulus to a resin magnet material, and considering use of an adhesive.

Further, a magnetic field is applied to the resin magnetic material during molding, magnet powder in the material is oriented and contributes to improvement in magnetic force of a magnetic pole, but a binder resin must have special thermomelt behavior in order to effectively enable this orientation in the extrusion molding, and there is also a problem that a resin selection range is limited.

The present invention was achieved by keenly examining the conventional magnet roller having various problems, and an object of the present invention is to provide a low-cost magnetic roller which has a high dimension accuracy in a longitudinal direction, a wide selection range of the binder resin, excellent recycle properties, and less environmental load by a new simple method of fitting and integrating a single metal shaft member having high rigidity and a pair of semicylindrical resin magnet members.

Means for Solving the Problem

According to a first aspect of the present invention, there is provided a magnet roller that forms a magnetic pattern around the roller and processes a charged material based on the magnetic pattern, wherein the magnet roller comprises: a single metal shaft member; and a pair of first and second semicylindrical resin magnet members each of which is shorter than the metal shaft member and has a first or second annular portion integrally provided at one end portion thereof, each of first and second central holes is provided at the center of each of the first and second annular portions, the first annular portion and the second annular portion are arranged so as not to face each other, and the magnet roller is assembled by sandwiching the metal shaft member between the first and second semicylindrical resin magnet members in such a manner that both end portions of the metal shaft member are inserted into the first and second central holes from the inner side of the first and second annular portions and protruded toward the outside of the first and second annular portions.

According to a second aspect of the present invention, in the magnet roller of the first aspect, each of first and second protrusions is provided on each end surface on the opposite side of each of the first and second annular portions of the first and second semicylindrical resin magnet members, first and second small holes are provided in the first and second annular portions separately from the first and second central holes, the first protrusion is inserted into the second small hole, and the second protrusion is inserted into the first small hole to achieve assembly.

According to a third aspect of the present invention, in the magnet roller of the first aspect, each of first and second protrusions is provided on each end surface on the opposite side of each of the first and second annular portions of the first and second semicylindrical resin magnet members, a notch is provided at a part of each of the first and second central holes, and the first protrusion or the second protrusion is inserted into the notch to achieve assembly.

According to a fourth aspect of the present invention, in the magnet roller of the first aspect, one or more shallow concave portions are provided on an outer peripheral surface of the metal shaft member sandwiched between the first and second semicylindrical resin magnet members, one or more convex portions are provided on an inner peripheral surface of the first and second semicylindrical resin magnet members facing the concave portions, and the concave portions and the convex portions are fitted to achieve assembly.

According to a fifth aspect of the present invention, in the magnet roller of the first aspect, at least one central hole of the first and second central holes is formed into a D-like shape, and a transverse cross section of a portion of the metal shaft member that is inserted into the D-shaped central hole is formed into a D-like shape.

According to a sixth aspect of the present invention, in the magnet roller of the fourth aspect, the concave portion is an annular groove formed on the entire outer peripheral surface of the metal shaft member.

According to a seventh aspect of the present invention, in the magnet roller of the first aspect, a concave streak parallel to an axial direction of the metal shaft member is formed on the outer peripheral surface of the semicylindrical resin magnet members in a longitudinal direction.

According to an eighth aspect of the present invention, in the magnet roller of the seventh aspect, a rod-like resin magnet having magnetic characteristics different from magnetic characteristics of the semicylindrical resin magnet members is fitted in the concave streak.

According to a ninth aspect of the present invention, in the magnet roller of the eighth aspect, the fitted rod-like resin magnet protrudes from the outer peripheral surface of the semicylindrical resin magnet member.

Effect of the Invention

According to the present invention, the pair of resin magnet members and the single metal shaft member are integrated by the simple fitting process, and the magnet roller having the high dimension accuracy can be obtained.

According to the present invention, since the selection range of the resin used for the binder of the resin magnet member is wide, the inexpensive resin can be adopted, the attachment process using the adhesive is not required in particular, and hence the magnet roller with the simple manufacture process and excellent economical efficiency can be obtained.

Further, the magnet roller according to the present invention which does not require the adhesive in particular has advantages of the good environment for manufacturing operations, the excellent recyclability, and less environmental loads.

Furthermore, according to the present invention, the concave streak is formed in a specific magnetic pole portion on the outer peripheral surface of the resin magnet member, and it is possible to obtain a magnet roller having a magnetic pole provided with a magnetic force, which is hardly exerted by the resin magnet member alone, by utilizing this groove.

BEST MODE(S) FOR CARRYING OUT THE INVENTION

Embodiments according to the present invention will now be described with reference to the drawings hereinafter.

First Embodiment

Figure 1:
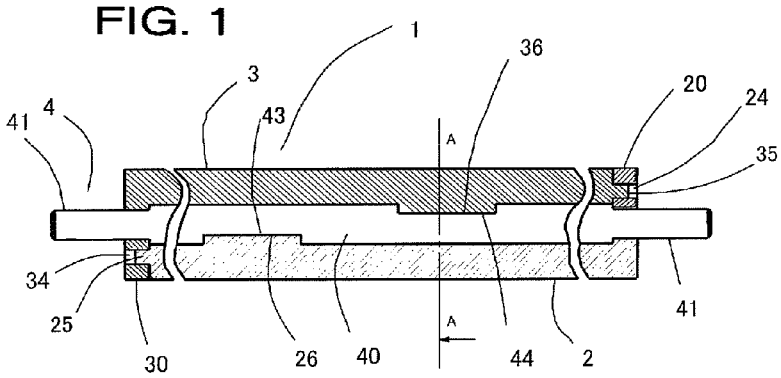
FIG. 1 is a cross-sectional view showing a magnet roller according to a first embodiment of the present invention taken along a roller axis.
Figure 2:
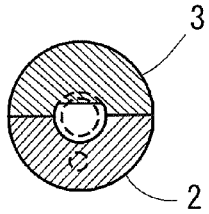
FIG. 2 is a cross-sectional view showing the magnet roller according to the first embodiment of the present invention taken along a line A-A in FIG. 1 to be vertical to the roller axis.
Figure 3:
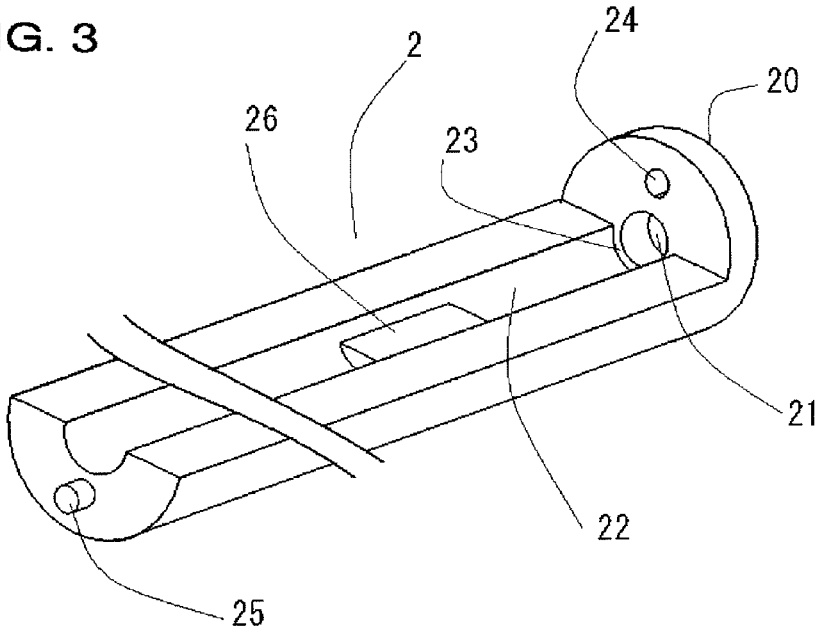
FIG. 3 is a perspective view showing one semicylindrical resin magnet member according to the first embodiment of the present invention from the inside of the cylinder when it is placed in a positional relationship of assembling into a magnet roller.
Figure 5:
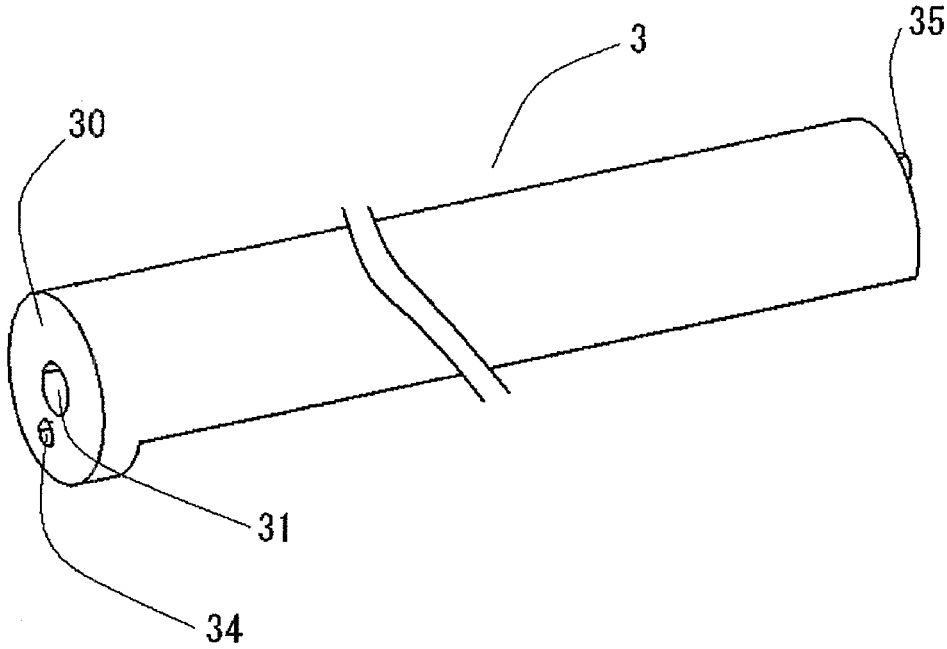
FIG. 5 is a perspective view showing the other semicylindrical resin magnet member according to the first embodiment of the present invention from the outside of the cylinder when it is placed in the positional relationship of assembling into the magnet roller.

As shown in FIG. 1, a magnet roller 1 according to a first embodiment of the present invention is constituted of a single metal shaft member 4 and a pair of first and second semicylindrical resin magnet members 2 and 3 shorter than this metal shaft member 4. As shown in FIG. 3 and FIG. 5, the semicylindrical resin magnet members 2 and 3 have the same shape and the same size and are formed into elongated semicylinders by injection molding, and each of first and second annular portions 20 and 30 is integrally provided at one end portion of each of these members 2 and 3. First and second central holes 21 and 31 are provided to run through the center of each of these annular portions 20 and 30. As shown in FIG. 3, a semicircular cavity 22 is formed in the semicylindrical resin magnet member 20. Although not shown, a semicircular cavity having the same shape and the same size is likewise formed in the semicylindrical resin magnet member 30. The first and second central holes 21 and 31 communicate with the semicircular cavity 22 in the member 20 and the semicircular cavity in the non-illustrated member 30. However, a bore diameter of each of the central holes 21 and 31 is smaller than a diameter of the cavity, and a step 23 is generated between each of the central holes 21 and 31 and the semicircular cavity 22. Although not shown, a step is likewise generated between the central hole 31 and the semicircular cavity in the semicylindrical resin magnet member 30.

Figure 4:
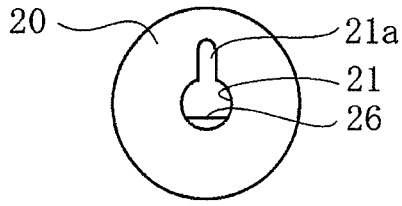
FIG. 4 is a view showing one semicylindrical resin magnet member according to the first embodiment having a notch provided in an annular portion.
Figure 6:
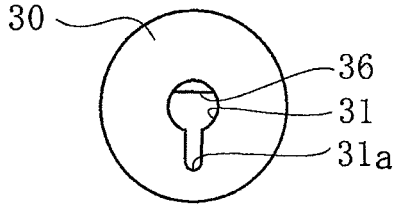
FIG. 6 is a view showing the other semicylindrical resin magnet member according to the first embodiment having a notch provided in an annular portion.
Figure 7:
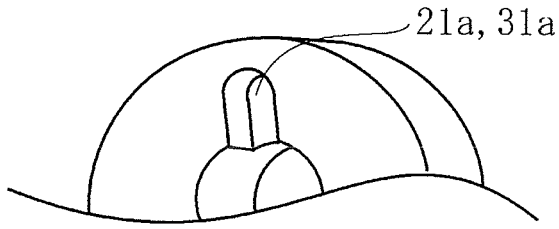
FIG. 7 is a view showing a state that the notch is shallowly provided in the annular portion of the semicylindrical resin magnet member.

As shown in FIG. 1, FIG. 3, and FIG. 5, a first protrusion 25 and a second protrusion 35 are provided on respective opposed end surfaces of the annular portions 20 and 30 of the semicircular resin magnet members 2 and 3. On the other hand, first and second small holes 24 and 34, into which the protrusions 25 and 35 can be inserted, are provided on outer peripheral sides of the annular portions apart from the central holes 21 and 31 in the annular portions 20 and 30. It is to be noted that the protrusions 25 and 35 and the first and second small holes 24 and 34, into which these protrusions can be inserted, are not restricted to such cylindrical shapes as shown in FIG. 1, FIG. 3, and FIG. 5. Furthermore, for example, as shown in FIGS. 4 and 6, a first notch 21*a* and a second notch 31*a* may be provided to the central holes 21 and 31 in place of providing the first and second small holes 24 and 34 so that the protrusions 25 and 35 can be inserted into these notches 21*a* and 31*a*, respectively. Moreover, as shown in FIG. 7, each of the notches 21*a* and 31*a* does not necessarily have to be provided to reach the opposite side of each of the annular portions 20 and 30, and it may be formed with a desired depth in accordance with a height of each of the protrusions 25 and 35.

Figure 8:
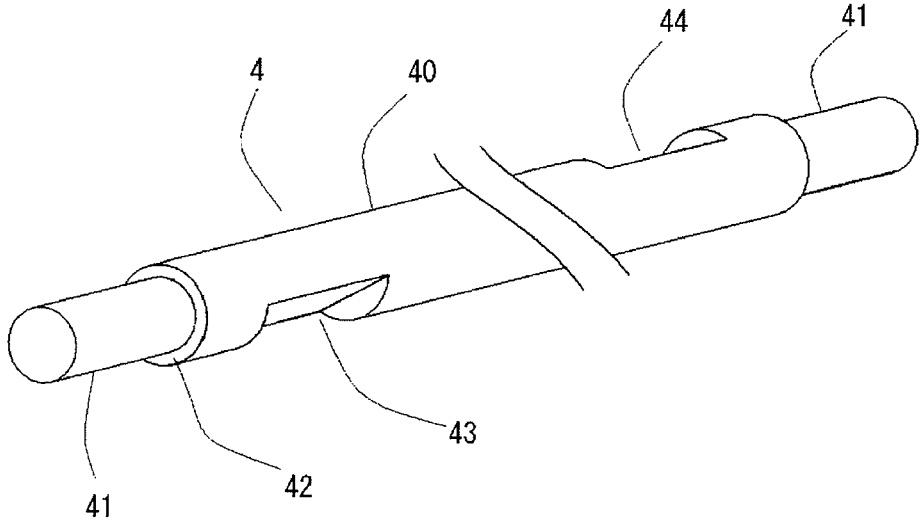
FIG. 8 is a perspective view of a metal shaft member according to the first embodiment of the present invention.
Figure 9:
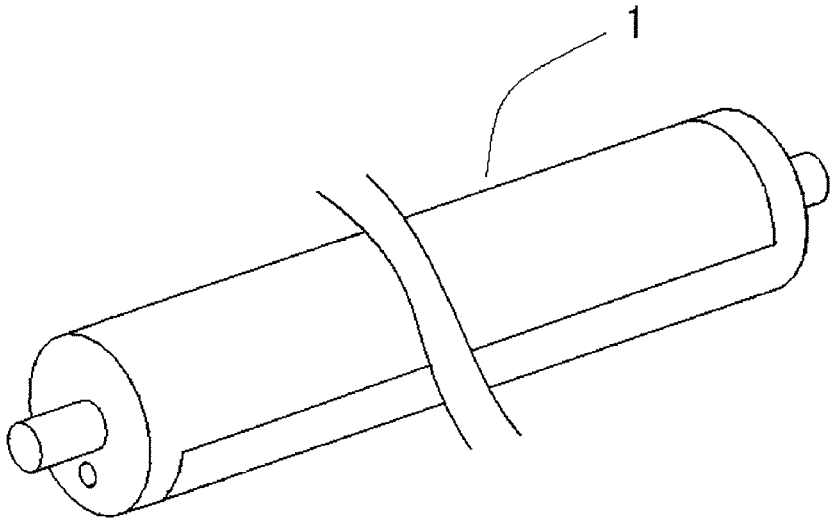
FIG. 9 is a perspective view of the assembled magnet roller according to the first embodiment of the present invention.

As shown in FIG. 8, the metal shaft member 4 constituting the magnet roller according to the first embodiment of the present invention is constituted of a cylindrical central portion 40 and support portions 41 and 41 which have a smaller diameter than the central portion and are integrally formed at both ends of the central portion. That is, the support portions 41 and 41 at both the ends are formed to narrowly protrude from ends 42 of the central portion. An outside diameter of the cylinder of the central portion 40 is substantially equal to a diameter of a cavity formed by overlapping the semicircular cavity 22 of the member 2 and the semicircular cavity of the non-illustrated member 3, and an outside diameter of each of the support portions 41 and 41 is substantially equal to a bore diameter of each of the central holes 21 and 31 of the respective members 20 and 30.

Although FIG. 3 and FIG. 5 show the example that each of the central holes 21 and 31 of the annular portions 20 and 30 has the circular shape and each of the support portions 41 and 41 has the cylindrical shape, at least one central hole of the annular portions 20 and 30 may be formed into a D-like shape, and a transverse cross section of at least one of the support portions 41 and 41, which is inserted into this D-shaped central hole, of the metal shaft member 4 may be formed into a D-like shape. Further, the cross section may be formed into a non-circular shape, e.g., a square shape besides the circular shape and the D-like shape. When the non-circular shape, e.g., the D-like shape or the square shape is adopted, an effect of avoiding idling of the metal shaft member can be enhanced, and these members can be further integrally fixed.

To assemble the magnet roller 1, the annular portion 20 and the annular portion 30 are arranged in such a manner that they do not face each other. Then, when the support portions 41 and 41 at both the ends of the metal shaft member 4 are inserted into the central holes 21 and 31 from the inner sides of the annular portions 20 and 30 and they are protruded to the outside of the annular portions 20 and 30, the central portion 40 of the metal shaft member 4 is sandwiched between the semicylindrical resin magnet members 2 and 3. That is, when one support portion 41 of the metal shaft member 4 is inserted into and passed through the central hole 21 of the annular portion 20 of the semicylindrical resin magnet member 2 from the inner side of the annular portion, the end 42 of the central portion 40 of the metal shaft member comes into contact with the step 23 of the semicylindrical resin magnet member and stops its forward movement. As a result, a relative position of the metal shaft member 4 and the semicylindrical resin magnet member 2 is determined and both these members are fitted, whereby a combination on a first stage is formed. Then, the other support portion 41 of the metal shaft member 4 produced from the combination is likewise inserted into and fitted in the central hole 31 of the annular portion 30 of the other semicylindrical resin magnet member 3.

When the other support portion 41 is inserted into and fitted in the central hole 31, the protrusion 25 is inserted into and fitted in the small hole 34, and the protrusion 35 is inserted into and fitted in the small hole 24, whereby a combination on a second stage is effected. As a result, the pair of semicylindrical resin magnet members 2 and 3 and the single metal shaft member 4 are fitted and appressed against each other, the support portions 41 and 41 at both the ends of the metal shaft member 4 protrude, and the integrated cylindrical magnet roller 1 is assembled.

Although the three members are tightly coupled with each other by the fitting means, in order to further reinforce this coupling, the following means is added and coupling force is enhanced in the first embodiment.

That is, as shown in FIG. 1, FIG. 3, and FIG. 8, two shallow concave portions 43 and 44 are provided on the outer peripheral surface of the central portion 40 of the metal shaft member 4 sandwiched by the semicylindrical resin magnet members 2 and 3. On the other hand, two convex portions 26 and 36 are provided on the inner peripheral surfaces of the semicylindrical resin magnet members 2 and 3 facing these concave portions 43 and 44. A depth of each of the concave portions 43 and 44 is substantially equal to a height of each of the convex portions 26 and 36. At the time of combining the semicylindrical resin magnet members with the metal shaft member, the convex portion 26 slides and is pressed into the concave portion 43, and the convex portion 36 slides and is pressed into the concave portion 44, respectively. This fitting means further enhances the contact and the coupling force of the semicylindrical resin magnet members and the metal shaft member, thereby obtaining the magnet roller having the excellent dimension accuracy and stability.

The semicylindrical resin magnet members constituting the magnet roller are formed by injection-molding a composition obtained by kneading powder of a ferrite magnet or a rare-earth magnet in a binder that contains polyamide, polyphenylene sulphide, polyolefin, or an ethylene ethyl acrylate copolymer as a main component. A magnetic field is applied to the inside of a metal mold at the time of molding, the magnet powder is magnetized and oriented, and necessary magnetic poles appear in the longitudinal direction of the outer peripheral surface of the semicylindrical resin magnet members. To generate the magnetic field, a permanent magnet or a coil electromagnet is used. The semicylindrical resin magnet members are left as they are or temporarily demagnetized and fitted in combination with the metal shaft member, and the integrated magnet roller is thereby formed. This magnet roller is additionally magnetized or remagnetized by a magnetizer as required.

Although several magnetic poles having different magnetic forces are generally generated on the semicylindrical resin magnet member surface obtained by the magnetic field molding, necessary magnetic forces may not be provided depending on the magnetic poles in some cases. The present invention suggests that the magnetic roller that solves this problem can be obtained by changing a shape of a region having a corresponding magnetic pole or a resin magnet material.

Figure 10:
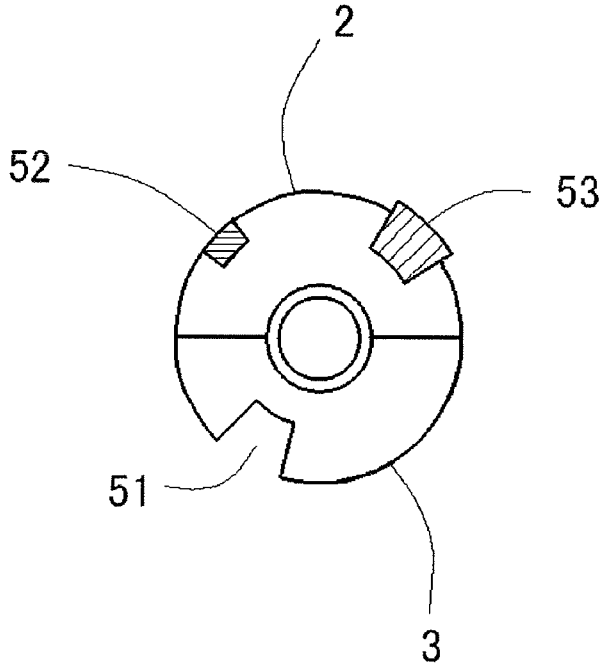
FIG. 10 is a view for explaining each concave streak formed on an outer peripheral surface of the semicylindrical resin magnet member and a rod-like resin magnet put in the concave streak.

FIG. 10 is a view for explaining that a concave streak parallel to the axial direction of the metal shaft member is formed on the outer peripheral surface of each semicylindrical resin magnet member in the longitudinal direction at the time of molding and a rod-like resin magnet is fitted in this concave streak.

As shown in FIG. 10, a concave streak 51 is formed on the semicylindrical resin magnet member 3, and a rod-like resin magnet is not fitted in this concave streak. A surface of this concave streak 51 exerts magnetic force lower than those of the other magnetic poles. Reference numeral 52 denotes a rod-like resin magnet that is fitted in the formed concave streak and has the same shape as the concave streak and higher magnetic characteristics than those of the semicylindrical resin magnet. A magnetic pole on a surface of the rod-like resin magnet 52 is present on the same circumference as the semicylindrical resin magnet member and exerts high magnetic force that cannot be achieved by the other magnetic poles. Reference numeral 53 designates a rod-like resin magnet that is fitted in a formed concave streak, formed into a shape that a magnet surface protrudes beyond the outer peripheral surface of the semicylindrical resin magnet member, and has high-magnetic characteristics. Since the surface of the rod-like resin magnet 53 protrudes beyond the outer peripheral surface of the semicylindrical resin magnet member, magnetic force produced by the magnetic pole of the rod-like resin magnet 53 causes a further strong effect on a target.

Second Embodiment

Figure 11:
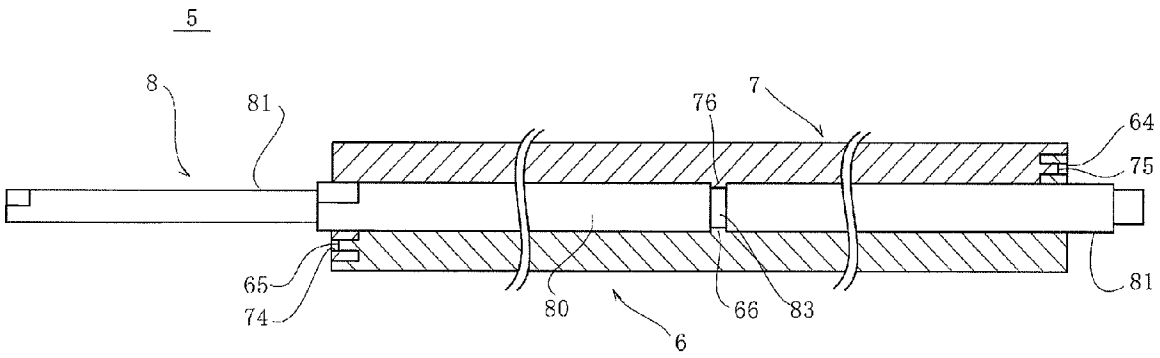
FIG. 11 is a cross-sectional view of a magnet roller according to a second embodiment of the present invention taken along a roller axis.
Figure 12:
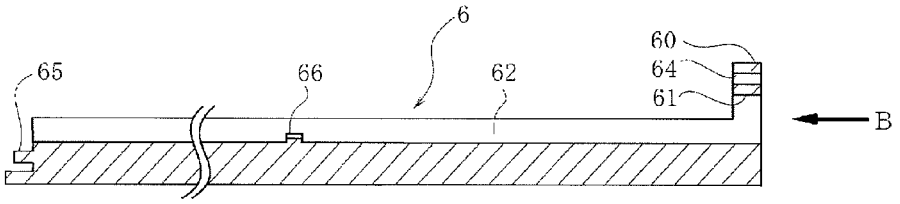
FIG. 12 is a cross-sectional view of one semicylindrical resin magnet member according to the second embodiment of the present invention taken along the roller axis.

A magnet roller according to a second embodiment of the present invention will now be described. As shown in FIG. 11, a magnet roller 5 according to the second embodiment of the present invention is constituted of a pair of first and second semicylindrical resin magnet members 6 and 7 and a single metal shaft member 8 like the magnet roller according to the first embodiment of the present invention. Further, the metal shaft member 8 is sandwiched between the pair of semicylindrical resin magnet members 6 and 7, and the three members are fitted and integrated with each other, thereby assembling a cylindrical roller that support portions 81 at both ends of the metal shaft member 8 protrude beyond the resin magnet members.

In the pair of semicylindrical resin magnet members 6 and 7, as shown in FIG. 12, FIG. 14, FIG. 16, and FIG. 18, a first or second annular portion 60 or 70 is integrally provided to one end portion of each elongated semicylinder. In the annular portion 60 or 70 of the magnet member according to this second embodiment, as shown in FIG. 13, FIG. 14, FIG. 17, and FIG. 18, a radius of a semicircle of the annular portion 60 or 70 is formed to be smaller than a radius of the semicylinder of the magnet members 6 and 7.

Figure 13:
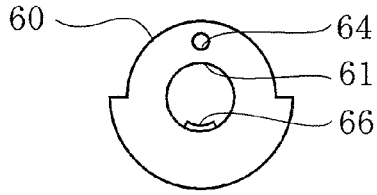
FIG. 13 is a view of an arrow B in FIG. 12.
Figure 14:
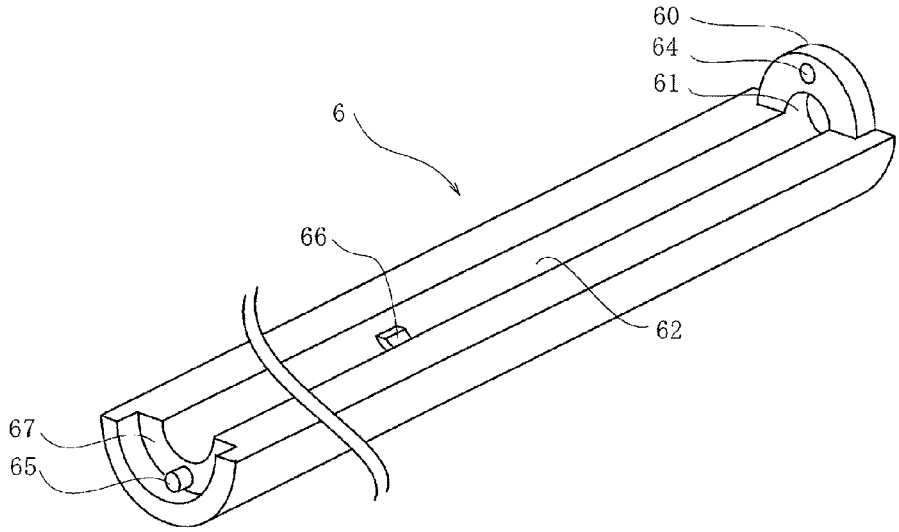
FIG. 14 is a perspective view showing the inside of the one semicylindrical resin magnet member according to the second embodiment of the present invention.
Figure 15:
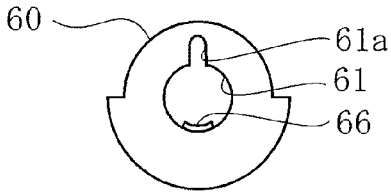
FIG. 15 is a view showing the one semicylindrical resin magnet member according to the second embodiment having a notch provided in an annular portion.
Figure 16:
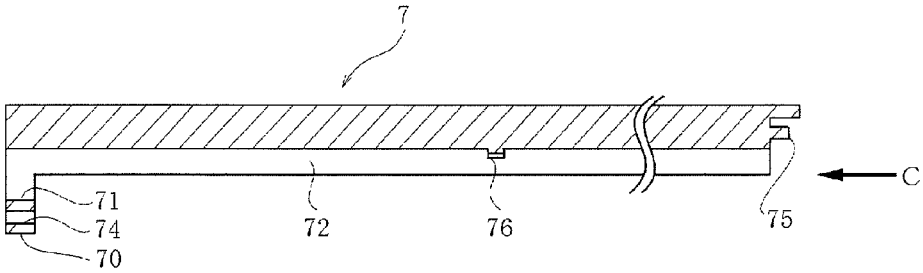
FIG. 16 is a cross-sectional view of the other semicylindrical resin magnet member according to the second embodiment taken along a roller axis.
Figure 17:
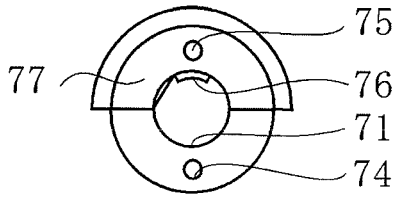
FIG. 17 is a view of an arrow C in FIG. 16.
Figure 18:
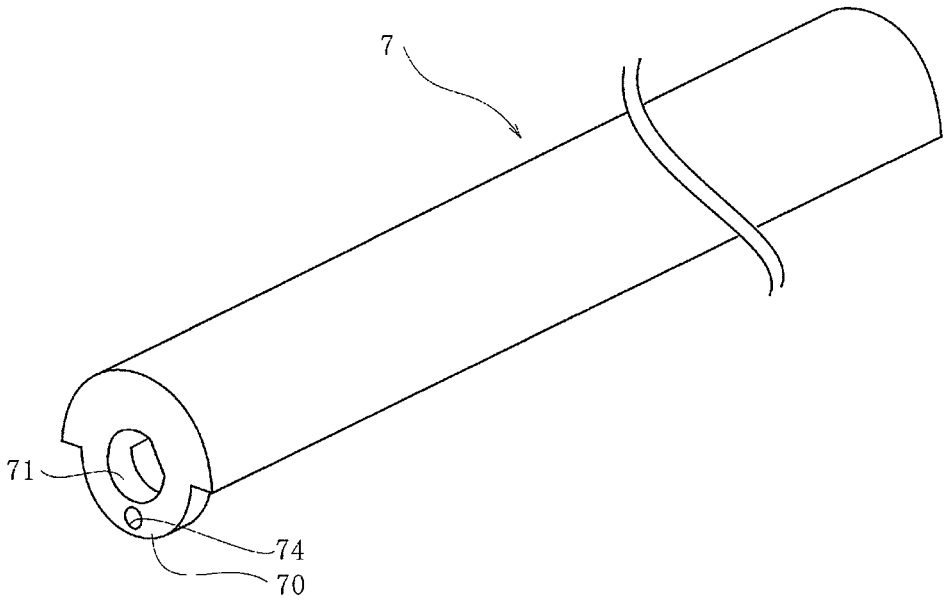
FIG. 18 is a perspective view showing the other semicylindrical resin magnet member according to the second embodiment from the outside thereof.
Figure 19:
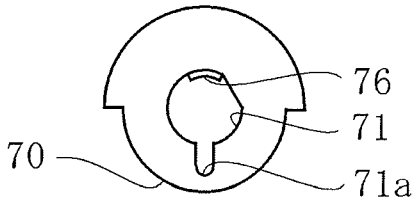
FIG. 19 is a view showing the other semicylindrical resin magnet member according to the second embodiment having the notch provided in the annular portion.

Furthermore, each of first and second central holes 61 and 71 is provided to run through the center of each of the annular portions 60 and 70. Each of the central holes 61 and 71 communicates with each of semicircular cavities 62 and 72 in the semicylindrical resin magnet members 6 and 7 shown in FIG. 12, FIG. 14, and FIG. 16. In this second embodiment, each of the central holes 61 and 71 is formed with a bore diameter equal to a diameter of each of the semicircular cavities 62 and 72, and a step described in the first embodiment is not generated between the central hole 61 or 71 and the semicircular cavity 62 or 72. Moreover, the central hole 61 of one semicylindrical resin magnet member 6 is formed into a circular shape as shown in FIG. 13 and FIG. 14, and the central hole 71 of the other semicylindrical resin magnet member 7 is formed into a D-like shape as shown in FIG. 17 and FIG. 18. In this embodiment, although the example that the central hole 71 of the one semicylindrical resin magnet member 7 alone is formed into the D-like shape because of a cost has been described, forming at least one central hole into the D-like shape can suffice, and the central holes 61 and 71 of both the semicylindrical resin magnet members 6 and 7 may be formed into the D-like shape. On the other hand, each of first and second recesses 66 and 67 which has the same dimension as a thickness of the annular portion 60 or 70 and is recessed toward the inner side is formed on the semicircular end surface on the opposite side of the annular portion 60 or 70 in the semicylindrical resin magnet member 6 or 7. A first or second protrusion 65 or 75 is formed on a surface of the recess 67 or 77. On the other hand, a first or second small hole 64 or 74 into which the protrusion 65 or 75 can be inserted is provided on the outer peripheral side of the annular portion apart from the central hole 61 or 71 of the annular portion 60 or 70. It is to be noted that each of the protrusions 65 and 75 and each of the first and second small holes 64 and 74 into which these protrusions can be inserted are not restricted to such cylindrical shapes as shown in FIG. 13, FIG. 14, FIG. 17, and FIG. 18 like the first embodiment. Likewise, as shown in FIG. 15 and FIG. 19, a first notch 61*a* and a second notch 71*a* may be provided to the central holes 61 and 71, respectively in place of providing the first and second small holes 64 and 74 so that the protrusions 65 and 75 can be inserted into these notches 61*a* and 71*a*. Furthermore, like the first embodiment, each of the notches 61*a* and 71*a* does not necessary have to be provided to reach the opposite side of each of the annular portions 60 and 70, and they may be formed with a desired depth in accordance with a height of each of the protrusions 65 and 75.

Figure 20:
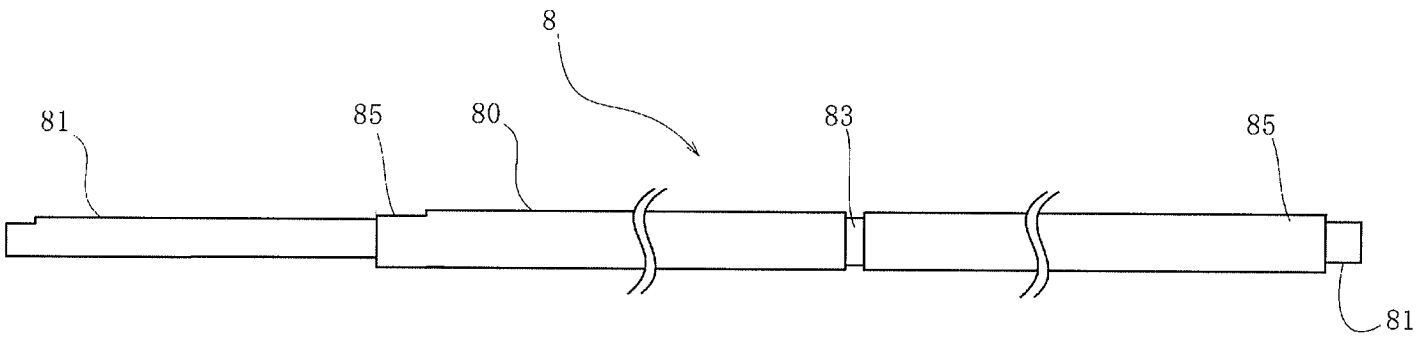
FIG. 20 is a view showing a metal shaft member according to the second embodiment.

As shown in FIG. 20, the metal shaft member 8 constituting the magnet roller according to the second embodiment of the present invention is constituted of a cylindrical central portion 80 and the support portions 81 and 81 which have a smaller diameter than that of this central portion 80 and are integrally formed at both ends of the central portion. As shown in FIG. 12 to FIG. 19, an outside diameter of the cylinder of the central portion 80 is substantially equal to a diameter of a cavity formed by overlapping the semicircular cavity 62 of the member 6 and the semicircular cavity 72 of the member 7, and it is substantially equal to the bore diameter of the central holes 61 and 71. Additionally, a cross section of at least one corresponding end portion 85 of the metal shaft member 8 is formed into D-like shape so that this end portion can be fitted in the central hole 71, which is formed into the D-like shape, of the semicylindrical resin magnet member 7, thereby avoiding idling of the metal shaft member 8. It is to be noted that the end portion 85 of the metal shaft member 8 means a portion that is inserted into the central hole 61 or 71 from a tail end of the metal shaft member 8. The hole shape of at least one central hole, the cross-sectional shape of the end of the central portion 80, and the cross-sectional shape of the corresponding end portion 85 of the metal shaft member 8 are not restricted to the D-like shape, and odd-shaped cross sections, e.g., a square cross section may be adopted.

To assemble the magnet roller 5, the annular portion 60 and the annular portion 70 are arranged in such a manner that they do not face each other. Then, when the support portions 81 and 81 at both the ends of the metal shaft member 8 are inserted into the central holes 61 and 71 from the inner sides of the annular portions 60 and 70 and they are protruded to the outside of the annular portions 60 and 70, the central portion 80 of the metal shaft member 8 is sandwiched between the semicylindrical resin magnet members 6 and 7. That is, when one support portion 81 of the metal shaft member 8 is inserted into and pass through the central hole 71 of the annular portion 70 of the semicylindrical resin magnet member 7 from the inner side of the annular portion, the support portion 81 pierces through the D-shaped end portion 85 of the metal shaft member 8, and forward movement stops. As a result, a relative position of the metal shaft member 8 and the semicylindrical resin magnet member 7 is determined and both these members are fitted, whereby a combination on a first stage is formed. Then, the other support portion 81 of the metal shaft member 8 produced from the combination is likewise inserted into and fitted in the central hole 61 of the annular portion 60 of the other semicylindrical resin magnet member 6.

When the other support portion 81 is inserted into and fitted in the central hole 61, the protrusion 65 is inserted into and fitted in the small hole 74, and the protrusion 75 is inserted into and fitted in the small hole 64, whereby a combination on a second stage is effected. Additionally, the semicircular portions of the annular portions 60 and 70 that have the smaller outside diameter than the radius of the semicylinders of the magnet members 6 and 7 are fitted in the recesses 77 and 67 formed on the end surfaces on the opposite side of the annular portions of the magnet members 6 and 7, respectively. As a result, the pair of semicylindrical resin magnet members 6 and 7 and the single metal shaft member 8 are fitted and appressed against each other, the support portions 81 and 81 at both the ends of the metal shaft member 8 protrude, and the integrated cylindrical magnet roller 5 is assembled.

Although the three members are tightly coupled with each other by the fitting means, in order to further reinforce this coupling, the following means is added and coupling force is enhanced in the second embodiment.

As reinforcing means described in this embodiment, as shown in FIG. 11 and FIG. 20, one shallow annular groove 83 is provided on the entire outer peripheral surface of the central portion 80 of the metal shaft member 8 sandwiched between the semicylindrical resin magnet members 6 and 7. On the other hand, as shown in FIG. 13 and FIG. 17, convex portions 66 and 76, each of which has a cross-sectional shape obtained by eliminating a central portion from a fan-like shape, are provided on the inner peripheral surfaces of the semicylindrical resin magnet members 6 and 7 facing this annular groove 83, respectively. A depth of the annular groove 83 is substantially equal to a height of the convex portions 66 and 76. At the time of combining the semicylindrical resin magnet members with the metal shaft member, the convex portions 66 and 76 slide and are pressed into the annular groove 83. This fitting means further enhances the contact and the coupling force of the semicylindrical resin magnet members and the metal shaft member, thereby obtaining the magnet roller having the excellent dimension accuracy and stability. Materials and a manufacturing method which are required for manufacturing the semicylindrical resin magnet members constituting the magnet roller according to the second embodiment can be obtained by injection molding using the above-described composition like the first embodiment. Further, like the first embodiment, in the magnet roller according to the second embodiment, the concave streaks or the rod-like resin magnets may be provided on each semicylindrical resin magnet member.

INDUSTRIAL APPLICABILITY

The magnet roller according to the present invention can be used in a developing device or a cleaning device in an image forming apparatus such as a printer, a copier, or a facsimile equipment that forms an image using a toner.

EXPLANATIONS OF REFERENCE NUMERALS

1, 5: magnet roller
2, 3, 6, 7: semicylindrical resin magnet member
20, 30, 60, 70: annular portion
21, 31, 61, 71: central hole
22, 62, 72: semicircular cavity
23: step
24. 34, 64, 74: small hole
25, 35, 65, 75: protrusion
26, 36, 66, 76: convex portion
4, 8: metal shaft member
40, 80: central portion
41, 81: support portion
42, 82: end of central portion
43, 44: concave portion
83: annular groove
51: concave streak
52, 53: rod-like resin magnet having high-magnetic characteristics

The invention claimed is:

1. A magnet roller that forms a magnetic pattern around the roller and processes a charged material based on the magnetic pattern, wherein the magnet roller comprises: a single metal shaft member; and a pair of first and second semicylindrical resin magnet members each of which is shorter than the metal shaft member and has a first or second annular portion integrally provided at one end portion thereof, each of first and second central holes is provided at the center of each of the first and second annular portions, the first annular portion and the second annular portion are arranged so as not to face each other, and the magnet roller is assembled by sandwiching the metal shaft member between the first and second semicylindrical resin magnet members in such a manner that both end portions of the metal shaft member are inserted into the first and second central holes from the inner side of the first and second annular portions and protruded toward the outside of the first and second annular portions.

2. The magnet roller according to claim 1, wherein each of first and second protrusions is provided on each end surface on the opposite side of each of the first and second annular portions of the first and second semicylindrical resin magnet members, first and second small holes are provided in the first and second annular portions separately from the first and second central holes, the first protrusion is inserted into the second small hole, and the second protrusion is inserted into the first small hole to achieve assembly.

3. The magnet roller according to claim 1, wherein each of first and second protrusions is provided on each end surface on the opposite side of each of the first and second annular portions of the first and second semicylindrical resin magnet members, a notch is provided at a part of each of the first and second central holes, and the first protrusion or the second protrusion is inserted into the notch to achieve assembly.

4. The magnet roller according to claim 1, wherein one or more shallow concave portions are provided on an outer peripheral surface of the metal shaft member sandwiched between the first and second semicylindrical resin magnet members, one or more convex portions are provided on an inner peripheral surface of the first and second semicylindrical resin magnet members facing the concave portions, and the concave portions and the convex portions are fitted to achieve assembly.

5. The magnet roller according to claim 4, wherein the concave portion is an annular groove formed on the entire outer peripheral surface of the metal shaft member.

6. The magnet roller according to claim 1, wherein at least one central hole of the first and second central holes is formed into a D-like shape, and a transverse cross section of a portion of the metal shaft member that is inserted into the D-shaped central hole is formed into a D-like shape.

7. The magnet roller according to claim 1, wherein a concave streak parallel to an axial direction of the metal shaft member is formed on the outer peripheral surface of the semicylindrical resin magnet members in a longitudinal direction.

8. The magnet roller according to claim 7, wherein a rod-like resin magnet having magnetic characteristics different from magnetic characteristics of the semicylindrical resin magnet members is fitted in the concave streak.

9. The magnet roller according to claim 8, wherein the fitted rod-like resin magnet protrudes from the outer peripheral surface of the semicylindrical resin magnet members.

* * * * *